US006626213B2

(12) United States Patent
Maritan et al.

(10) Patent No.: US 6,626,213 B2
(45) Date of Patent: Sep. 30, 2003

(54) DRINK DISPENSER DEVICE FOR DOMESTIC REFRIGERATORS

(75) Inventors: Marco Maritan, Viggiú (IT); Armando Luisi, Varese (IT); Carlo Bianchi, Seveso (IT)

(73) Assignee: Whirlpool Corporation, Benton Harbor, MI (US)

( * ) Notice: Subject to any disclaimer, the term of this patent is extended or adjusted under 35 U.S.C. 154(b) by 29 days.

(21) Appl. No.: 09/962,377

(22) Filed: Sep. 25, 2001

(65) Prior Publication Data

US 2002/0069935 A1 Jun. 13, 2002

(30) Foreign Application Priority Data

Sep. 26, 2000 (IT) ..... MI2000A2087

(51) Int. Cl.[7] ..... B65B 1/04; B65B 3/04; B67C 3/00

(52) U.S. Cl. ..... 141/293; 141/285; 141/291; 141/351; 141/360; 141/362; 222/185.1; 222/189.09; 62/389

(58) Field of Search ..... 141/192, 285, 141/291–293, 295, 311 R, 319–321, 328, 348–351, 360, 362, 82; 222/185.1, 189.09, 146.6, 332, 387, 442; 62/389, 391, 457.4; 251/337

(56) References Cited

U.S. PATENT DOCUMENTS 2,274,409 A 2/1942 Harbison ..... 62/141
4,161,971 A * 7/1979 Arzberger et al. ..... 141/362
4,210,262 A * 7/1980 Donaldson ..... 222/442
5,542,265 A 8/1996 Rutland ..... 62/389
5,743,294 A 4/1998 Donzella ..... 137/588
5,791,517 A * 8/1998 Avital ..... 222/1
5,799,841 A * 9/1998 Wirt ..... 222/571

OTHER PUBLICATIONS

European Patent Application No. 0112938, Publication date Jul. 11, 1984, Inventor Raymond Clough.

PCT, International Publication No. WO 00/02796, Publication Date Jan. 20, 2000, Inventor Ruggero Cera.

* cited by examiner

*Primary Examiner*—Timothy L. Maust
(74) *Attorney, Agent, or Firm*—Stephen Krefman; Robert O. Rice; John F. Colligan

(57) ABSTRACT

A dispenser device for refrigerated drinks (carbonated or not) for domestic refrigerators, the drinks being drawn from containers (bottles and vessels in general) removably coupled to the device and dispensed via valve means forming part of the device, said device comprising a removable component to be connected to the container and forming part of a pneumatic path valve-controlled between the atmosphere and the container, said dispensing valve means being linearly movable against elastic means, both the valving control of the pneumatic path and the operation of the valve means being effected by a single mechanical control member.

15 Claims, 1 Drawing Sheet

DRINK DISPENSER DEVICE FOR DOMESTIC REFRIGERATORS

BACKGROUND OF THE INVENTION

1. Field of the Invention

The present invention relates to a domestic refrigerator device for dispensing carbonated or non-carbonated drinks, including water, the drinks being drawn from containers (bottles and vessels) removably coupled to said device and dispensed via valve means forming part of the device. The device of the invention is applied, together with its container, to the refrigerator door on the same side as the refrigerated compartment, so that the dispensed drink is refrigerated.

2. Description of the Related Art

U.S. patent application Ser. No. 09/755,831 filed Jan. 5, 2001 entitled "Refrigerated water dispenser for refrigerators", describes a refrigerated water dispenser in which a water delivery port is situated within a compartment bounded by a structure mounted on the outside of the door.

This application states that the port is connected to the water main via a heat exchanger (for refrigerating the water) and a solenoid valve which is energized, for dispensing, when the user, for example by means of a drinking glass, acts on an electric switch positioned in said compartment.

The described solution is of particular merit with regard to the provision of the structure mounted on the outside of the door and provided with the compartment in which the water dispensing port is present, however its concept of an associated heat exchanger, a connection to the water main and a solenoid valve introduces substantial constructional complexity from the hydraulic and electrical viewpoints, the resultant cost of which can be justified only in luxury refrigerators of corresponding price.

SUMMARY OF THE INVENTION

An object of the present invention is to provide a dispenser device of essentially mechanical operation, which uses as the drink source a bottle or container removably connected to the device.

A further object is to provide a dispenser device which can be used both with carbonated drinks and with tap water from a vessel.

These and further objects which will be more apparent from the ensuing detailed description are attained by a device in accordance with the teachings of the accompanying claims.

BRIEF DESCRIPTION OF THE DRAWINGS

The invention will be better understood from the detailed description of a preferred embodiment thereof given hereinafter by way of non-limiting example with reference to the accompanying drawing, in which.

DESCRIPTION OF THE PREFERRED EMBODIMENT

Figure 1:
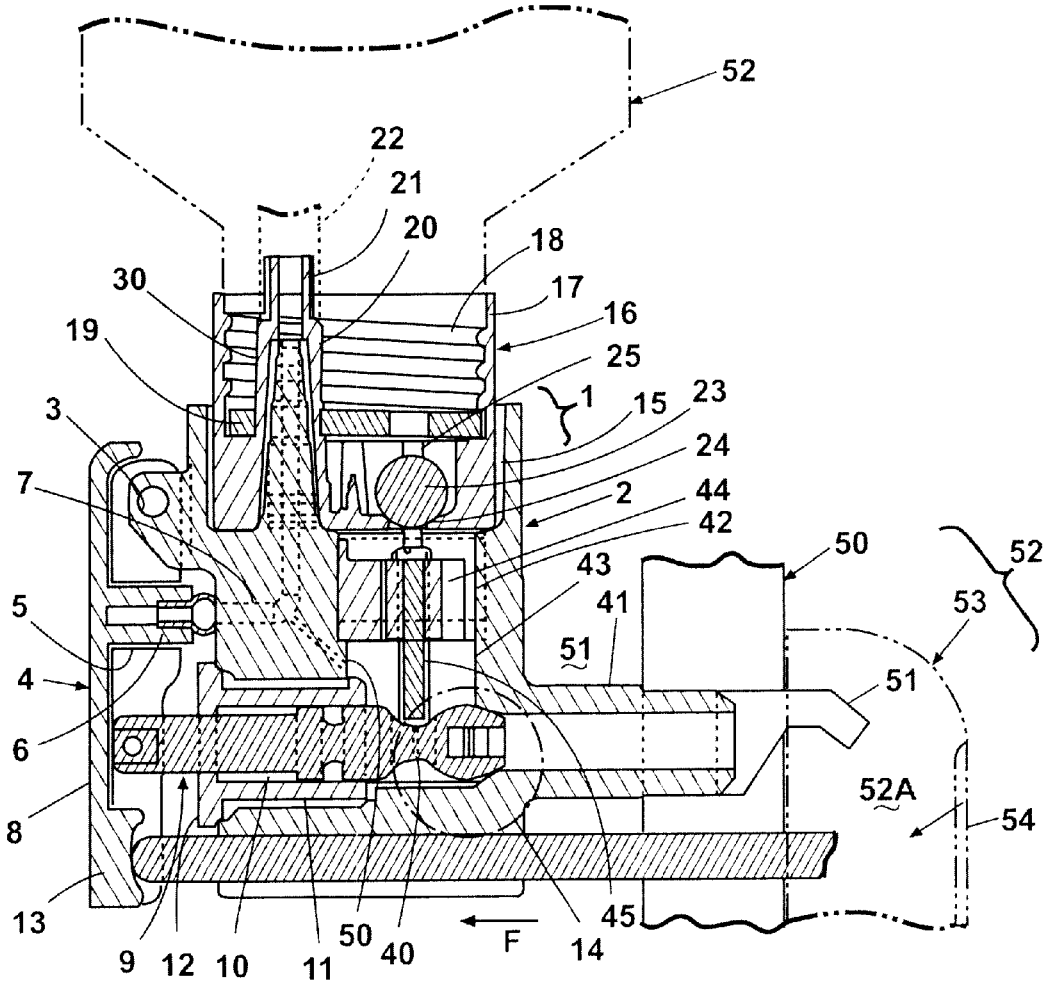
FIG. 1 is a longitudinal vertical section through the device of the invention.

With reference to the figures, the reference numeral 1 indicates the device of the invention overall, it comprising a casing 2, for example of moulded engineering polymer, to which a lever 4, for example of moulded engineering polymer, is hinged at 3.

The lever presents, in the following order from the bottom upwards of FIG. 1:

a) a holed projection 5 which receives the stem of a mushroom valving element 6 (of elastic or elastomeric material) intended to close the outlet to atmosphere of a channel 7 provided within the casing 2;

b) a pivot 8 of a piston valve member 9 loaded by a spring 10 and slidingly mounted fluid-tight in a cylinder 11 screwed into a hole in the casing 2 by way of a seal gasket 12;

c) a concave support 13 for the rounded end of an operating rod 14 slidingly mounted in a through hole in the casing 2.

The casing 2 upperly presents a substantially cylindrical seat 15 for a removable component 16 of the device. The removable component 16 consists of a cylindrical body 17, internally threaded at 18 for a certain predetermined depth and provided with:

a) a seal gasket 19;

b) a tubular appendix 20 slightly conical for a certain length and terminating upperly with a depressed part 21 on which the end of a removable tube 22 is forcibly mounted;

c) a ball 23 positioned between the gasket 19 and the base of the component 16 and intended to close an aperture 24 present in said base (the ball is suitably guided by projections 25 on the sides of the component 16).

When the component 16 is in the position shown in FIG. 1, its tubular appendix 20 is mounted about an appendix 30 projecting from the base of the seat 19, into which seat there extends the said channel 7 closed by the mushroom valving element 6.

The piston valve member 9 (which can be of rubber) comprises a concave annular groove 40 and a head which seals against an exit or dispensing conduit 41 forming part of the casing 2.

The piston valve member extends through the base region of a cylindrical seat 43 in the casing 2.

In the cylindrical seat 43 there is mounted a removable insert 42 provided with passages 44. In this insert there is slidingly mounted a pusher 45, the lower end of which cooperates with the piston valve member 9, whereas its upper end cooperates with the ball 23 to withdraw it from the aperture 24.

In the non-limiting example represented herein the dispensing conduit 41, or possibly an extension thereof, passes through the door 50 of a refrigerator (in the refrigerated compartment of which there being located the device of the invention and a container 52 from which the carbonated or non-carbonated drink to be delivered is drawn). The conduit leads to a spout 51 positioned in a compartment 52A bounded by a structure 53 mounted on the outside of the door 50 and provided with a flap 54 hinged to the structure 53, to rotate against an elastic reaction and act on the rod 14.

Figure 2:
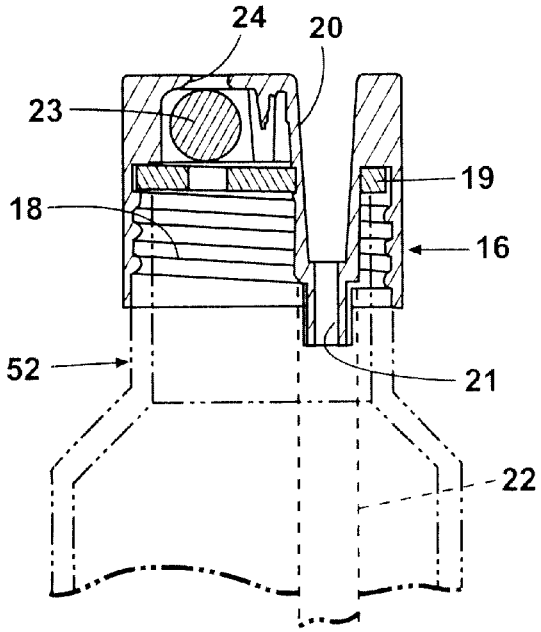
FIG. 2 is a section through a removable component of the device.

The bottle or other vessel 52 presents a thread corresponding to the thread 18 and by which it is coupled (see FIG. 2) to the removable component 16 after removing it from the seat 15 of the casing 2. The tube 22, of length adequate to reach the bottom of the vessel 52 and secured to the component 16, is inserted into the bottle before screwing the two together.

The bottle 52 with the component 16 is inverted and coupled to the casing 2 as shown in FIG. 1.

When the user wishes to obtain a drink from the bottle he moves (in the stated manner) the operating rod 14 in the direction of the arrow F. This movement causes the level 4 to rotate clockwise about the pivot 3 with consequent opening of the passage formed by the channel 7and tube 22, this passage connecting the atmosphere to the bottom (now the top) of the bottle to balance the pressures. It should be noted that any drink originally contained in the tube 22 is discharged into the seat 43 through a narrow channel 60.

The said clockwise rotation of the lever 13 causes the piston valve member 9 to move, against the spring 10, in the direction of the arrow F, to open the dispensing conduit. By the effect of this, and as a consequence of the shape of the member 9, the pusher 45 rises and withdraws the ball 23 from the hole 24, to enable the drink to be dispensed by the spout 51 into an underlying drinking glass (not shown) through the path extending through the component 16, the aperture 24, the passages in the insert 42, the cylindrical seat 43 and the conduit 41.

Dispensing ceases when the user ceases to push the rod 14 in the direction of the arrow F, enabling the spring 10 to return the device into the position of FIG. 1.

We claim:

1. A dispenser device for refrigerated drinks for domestic refrigerators, the drinks being drawn from containers removably coupled to the device and dispensed via a dispensing valve forming part of the device, the dispenser device comprising a removable component to be connected to the container and forming part of a pneumatic path that is valve-controlled between the atmosphere and the container, the dispensing valve being linearly movable against elastic means, both the valve control of the pneumatic path and the operation of the dispensing valve being effected by a single mechanical control member.

2. A device as claimed in claim 1, wherein the removable component is screw-connectable to the container.

3. A device as claimed in claim 2, wherein the removable component comprises a valve and part of the pneumatic path, the part comprising a tube arranged to enter the container and to reach or nearly reach the bottom thereof.

4. The device according to claim 3, wherein the removable component engages the device in a seat thereof via a channelled part of the seat with which a tubular appendix of the removable part engages, the channelled part and the tubular appendix forming part of the pneumatic path.

5. A device as claimed in claim 4, wherein the control member is a rod acting on a lever to which both the dispensing valve and the valve control are connected.

6. A device as claimed in claim 5, wherein the dispensing valve comprises a piston valve shaped to cause the opening of the valve of the removable component simultaneously with the opening of the piston valve.

7. A device as claimed in claim 6, wherein the valve of the removable component is opened by a slidable pusher controlled by the dispensing valve.

8. A device as claimed in claim 7, wherein the drink is dispensed via a spout situated in a compartment bounded by a structure applied to the outside of the refrigerator door.

9. A dispenser device for refrigerated drinks for domestic refrigerators, the drinks being drawn from containers removably coupled to the device and dispensed via a dispensing valve forming part of the device, the device comprising a removable component being screw-connectable to the container and forming part of a pneumatic path valve-controlled between the atmosphere and the container, the removable component comprising a valve and part of the pneumatic path, the part comprising a tube arranged to enter the container and to reach or nearly reach the bottom thereof the removable component engages the device in a seat thereof via a channelled part of the seat with which a tubular appendix of the removable part engages, the channelled part and the tubular appendix forming part of the pneumatic path, the dispensing valve being linearly movable against elastic means, both the valve control of the pneumatic path and the operation of the dispensing valve being effected by a single mechanical control member.

10. A device as claimed in claim 9, wherein the control member is a rod acting on a lever to which both the dispensing valve and the valve control are connected.

11. A device as claimed in claim 10, wherein the dispensing valve comprises a piston valve shaped to cause the opening of the valve of the removable component simultaneously with the opening of the piston valve.

12. A device as claimed in claim 11, wherein the valve of the removable component is opened by a slidable pusher controlled by the dispensing valve.

13. A device as claimed in claim 12, wherein the drink is dispensed via a spout situated in a compartment bounded by a structure applied to the outside of the refrigerator door.

14. A device as claimed in claim 13 wherein the structure comprises a rotatable flap for access to the compartment.

15. A device as claimed in claim 13, wherein the structure comprises a rotatable flap for access to the compartment.

* * * * *